United States Patent [19]

Bovender

[11] 4,052,983

[45] Oct. 11, 1977

[54] NASAL FILTER

[76] Inventor: Coy R. Bovender, 6123 Auburndale Drive, Greensboro, N.C. 27410

[21] Appl. No.: 743,631

[22] Filed: Nov. 22, 1976

Related U.S. Application Data

[63] Continuation-in-part of Ser. No. 610,259, Sept. 4, 1975, abandoned.

[51] Int. Cl.[2] ..... A62B 7/10

[52] U.S. Cl. ..... 128/140 N; 55/124; 55/131; 55/155; 55/485; 55/489; 55/490; 55/529; 55/DIG. 35; 55/103; 128/146.2; 128/206

[58] Field of Search ..... 55/103, 124, 131, 155, 55/427, 482, 485, 489, 490, 528, 529, DIG. 35; 128/140 R, 140 N, 146.2, 206

[56] References Cited

U.S. PATENT DOCUMENTS

| | | | |
|---|---|---|---|
| 2,151,227 | 3/1939 | Pawelek | 228/140 N |
| 2,192,093 | 2/1940 | Moore | 128/140 N |
| 2,526,586 | 10/1950 | Shuff | 128/140 N |
| 2,528,303 | 10/1950 | Gillespie | 55/477 |
| 2,812,038 | 11/1957 | Krueger | 55/103 |
| 2,945,557 | 7/1960 | Powers | 55/103 |
| 2,992,700 | 7/1961 | Silverman et al. | 55/103 |
| 3,457,917 | 3/1969 | Mercorio | 128/140 N |
| 3,747,597 | 7/1973 | Olivera | 55/529 |
| 3,802,426 | 4/1974 | Sakamoto | 28/140 N |
| 3,884,223 | 5/1975 | Keindl | 128/140 N |

OTHER PUBLICATIONS

G. Arnold et al., Axial Flow Filter Cartridge, IBM Technical Disclosure Bulletin, vol. 13, No. 9 (Feb., 1971).

*Primary Examiner*—Frank W. Lutter
*Assistant Examiner*—David L. Lacey
*Attorney, Agent, or Firm*—Charles R. Rhodes

[57] ABSTRACT

A replacable, sectionalized filter cartridge is received within a casing which is adapted to be inserted and removed from the nasal passage. The filter cartridge is preferably formed with two filter sections, one a nylon, cilia-like membrane, and one a polypropylene cilia-like membrane. If desired, in an alternate embodiment, a third honeycomb section separating the outer sections may be provided. The materials which form the outer filter sections are so chosen as to become electrostatically charged responsive to the movement of air thereby.

7 Claims, 2 Drawing Figures

NASAL FILTER

REFERENCE TO RELATED APPLICATIONS

Figure 1:
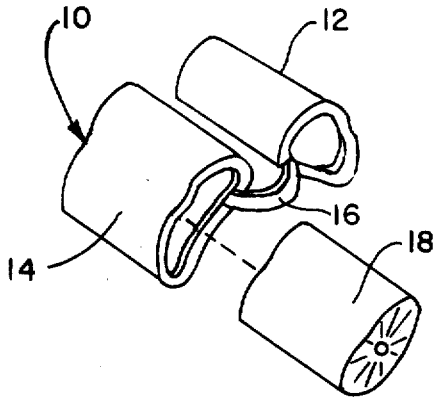

This application is a continuation-in-part of my earlier application Ser. No. 610,259 filed Sept. 4, 1975 now abandoned.

SUMMARY OF THE INVENTION

In general, the present invention is directed to a filter device insertable into the nasal passages which includes a pair of flexible casings, generally corresponding in shape to the interior of the nasal passage. Each casing releasably receives a filter cartridge which may be used for a period of time and then removed, discarded and replaced by a new cartridge.

The filter cartridges themselves preferably include two portions or filter sections. In an upper section a porous membrane formed of suitable material carries a multitude of cilia-like, nylon filaments which act similarly to the natural cilia (minute hair) of the mucous membrane of the human nose during the respiration process. As air moves past the nylon cilia and through the porous membrane which carries the nylon filament, the air movement causes the nylon material to become electrostatically charged to aid in the filtering process.

The lower section of the filter cartridges is formed much in the way of the upper section, except the filamentary material is formed of polypropylene, which also becomes electrostatically charged as air passes thereby. It is felt that the polypropylene charge will attract certain of the contaminates from the air, while the nylon electrostatic charge will attract other contaminates from the air.

If desired, a mechanical filter in the nature of a honeycomb type material formed of linen, or other such material may be provided to separate the upper and lower filter sections and also to mechanically filter certain contaminates from the air.

The nylon and polypropylene electrostatically charged cilia tend to separate contaminates from the air by means of the phenomenon known as "electrostatic cling," such as exhibited in certain materials after being washed and dried.

A nasal filter, such as described hereinabove, provides significant improvements in various types of situations. For example, an efficient and effective filter of the type described herein could have tremendous benefits in preventing bysinosis in the textile industry; brown lung and black lung disease in the coal mining industry; lung hazards in the furniture industries; for various allergies such as dust, pollen, cosmetic sprays and the like; could provide a discrete filtering device for persons working with toxic chemicals; and could prove useful for persons in areas of high air pollution and in the farming industry. If desired, one or more of the filter sections may be treated with a medicant such as mentholatum for people with allergies or with an enzyme such as lysosymes (a bacteria killing enzyme normally present in human beings, but sometimes not present in sufficient quantity to prevent infection).

Very few attempts have been made in the past to provide a filter apparatus that is actually inserted into the nasal passage, and such attempts have generally been limited to merely a screen or gauze filter carried by some type of removable casing. Such attempts are illustrated in the United States Letters Patent to Beber No. 3,145,711 and Wilson U.S. Pat. No. 682,123. A similar type device is also illustrated and described in German Pat. No. 668,393 of Dec. 2, 1938.

The removable cartridge of the present invention is considered to be substantially superior to these efforts in that, first of all, the removable filter cartridge is designed to substantially reconstruct the cilia of the mucous membrane normally present in the nasal passage, which however, due to our environment or due to allergies, has become damaged or destroyed.

Secondly, one or more of the filter sections within the removable and replacable cartridges include a filamentary filter media which develop an electrostatic charge as air passes therethrough. This charged filter section aids in the filter process in that earlier filters were merely mechanical type such as screens or gauze which mechanically trap dust particles, but cannot effectively collect smaller particles. Although such small particles may be smaller than the openings in a mechanical filter, they are harmful enough to cause irritation or damage to the user. For example chemical gasses or other minute contaminates or pollutants which are harmful, yet very small, might easily pass through a screen or gauze filter. In the filter according to the present invention the electrostatic "cling" effect will be effective to collect particles which are smaller than the openings of a mechanical filter.

Finally, the removable cartridge provides a filtering device which may be easily changed as the filter becomes dirty with a minimum of trouble and effort.

It is therefore an object of the present invention to provide a discrete nasal filter exhibiting improved filter characteristics.

It is further an object of the present invention to provide an improved nasal filter of the type described in which a replaceable filter section is inserted into the nasal passage itself.

Another object of the present invention is to provide an improved nasal filter device in which the filter section is designed to simulate the cilia-like portion of the mucous membrane of the interior of the nasal passage.

A further object of the present invention is to provide an improved nasal filter of the type described in which the filtering process is primarily carried out electrostatically.

Figure 2:
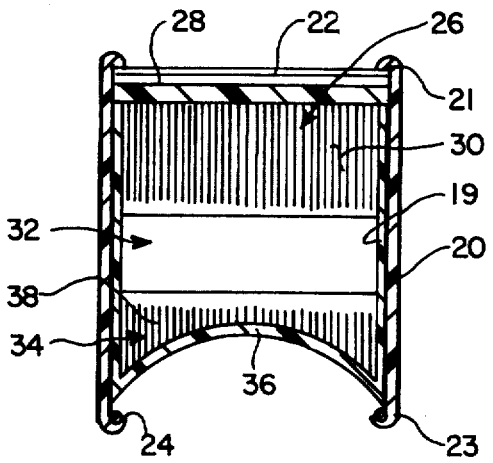

These and other objects of the present invention will become apparent upon reading the following detailed description of the preferred embodiment in conjunction with the accompanying drawings in which:

FIG. 1, is an exploded, perspective view of the nasal filter according to the present invention, with the cartridge illustrated as being removed therefrom; and FIG. 2 is a longitudinal sectional view of one of the nasal casings illustrated in FIG. 1.

Turning now to a more detailed description of the invention, there is illustrated in FIG. 1 the nasal filter 10 according to the present invention which includes a pair of hollow tubular casings 12,14, each of which is adapted to be inserted into one of the nostrils. A bridging member 16 connects the two casings 12,14 to prevent lodging of the casings in the nostrils. A removable and replaceable filter cartridge 18 in which the present invention resides is insertable in each of the casings 12,14 as will be explained more in detail hereinafter.

In general, the filter cartridge 18 is designed to simulate the lining of the mucous membrane as closely as possible. In this respect, one or more filter sections are provided and include a porous membrane formed of a synthetic material and having a plurality of fibers, filament or strands depending therefrom, resembling to a significant extent the ciliary nature of the mucous membrane. The synthetic cilia-like material should be formed of a material such as nylon or polypropylene which becomes electrostatically charged in the presence of air flow therepast to develop "electrostatic cling," which further enhances the filter operation.

Turning now to a more specific description of one of the casings or containers 12,14, the casing should be formed of a porous, clear, resilient material such as vinyl, molded rubber or non-toxic, glycerin gelatinous material. The casings are of such an exterior shape as to fit comfortably within the nostril, and in this respect, are made in three basic shapes and sizes, each one designed to conform to the shape of a Caucasic, Oriental, or Negroid nose.

Further, each casing comprises a tubular wall 20 having an upper rim 21, which engages and holds a grating member 22. Grating 22 comprises a stainless steel mesh or grate covered with a vinyl material, and, of course, includes openings therein through which air freely passes. The lower end or rim 23 of wall 20 includes an annular wire member 24 imbedded therein, so that the lower end can be unrolled or rolled to retain the removable cartridge 18 therein. As illustrated in FIG. 2, the cartridge 18 comprises a tubular outer wall 19 of such size and shape as to slip into wall 20 and remain therein by means of a friction fit in addition to the upper grating 22 and rolled lower rim 23. Within the filter cartridge 18 illustrated in FIG. 2 are three distinct filter sections 26, 32 and 34, although it should be realized that at least the intermediate section 32 could be omitted.

The upper filter section 26 includes a porous membrane or blanket 28 formed of nylon or other similar material and having a plurality of other openings therein so that air can freely pass therethrough. A plurality of fibers 30 formed of nylon or other similar material have one end retained within blanket 28 and extend downwardly therefrom to form the cilia-like effect.

The middle or intermediate section 32, which may be eliminated, if desired, is formed of a stiff material such as linen or the like folded into a honeycomb structure so that air is permitted to pass therethrough, however, is subjected to mechanical filtering.

The lower filter section 34 is similar to upper section 26, in that it comprises also a porous membrane or blanket 36 formed of polypropylene or other similar material. Blanket 36 is concave so as to be less visible when in place and also includes a plurality of polypropylene fibers or filament secured at one end thereto and extending upwardly into the filter section toward the honeycomb middle section 32.

Both the nylon and polypropylene cilia-like sections 30,38 will become electrostatically charged as air passes through the filter creating "cling" which significantly improves the filter action of the device. Although nylon and polypropylene have been designated and preferable materials, it is apparent that other materials which generate electrostatic charge in the presence of moving air could be used within the scope of this invention.

The filter cartridges 18 according to the present invention can be medicated in several ways. For example, the top of the honeycomb filter section 32 may be treated with lysosyme (an enzyme normally present in the nasal passage to kill bacteria, however, is in insufficient quantity in many people). Also, for people with allergies, the top of the honeycomb area could be slightly metholated. Further, compositions could be added to insure that the filter is neither acidic or basic, and remains at a neutral pH of 7, at which both the ciliary nature of the mucous membrane and the activity of the lysosymes are most effective.

Although the filter cartridge 18 according to the present invention preferably comprises at least two filter sections, it is apparent that satisfactory results could be achieved with only the upper or lower section, without necessarily having both the nylon and polypropylene cilia-like sections 26,34.

Further, although a preferred embodiment of the present invention has been described hereinabove, it is apparent that various changes and modifications could be made to the invention without departing from the scope thereof, which is set forth in the following claims:

What is claimed is:

1. A filter device for insertion into the nasal passage comprising:

a. a hollow casing formed of a soft pliable material and having an outer transverse dimension shaped substantially to conform to the contour of the inner wall of the nasal passage and an inner transverse dimension;

b. a removable and disposable filter cartridge means carried within said casing and comprising:

i. a housing having outer transverse dimensions closely corresponding to the inner transverse dimensions of said casing for removable, yet stationary support within said casing;

ii. at least one filter section formed of a porous membrane extending transversely across said housing;

iii. a multiplicity of minute artificial fibers depending from said membrane, whereby said filter cartridge means simulates the natural cilia of the mucous membrane.

2. The filter device according to claim 1 wherein said artificial fibers are formed of a material which generates an electrostatic charge in the presence of moving air.

3. The filter device according to claim 2 wherein said fibers are nylon.

4. The filter device according to claim 1 wherein said filter cartridge means comprises a second, lower porous membrane spaced from the first mentioned porous membrane and having a plurality of minute artificial fibers extending upwardly therefrom.

5. The filter device according to claim 4 wherein said filter cartridge means comprises a second type of filter section adjacent said first type of filter section, said second type of filter section including filter material having a honeycomb configuration.

6. The filter device according to claim 4 wherein the artificial fibers extending from one membrane are formed of a material that generates an electrostatic charge of one polarity in the presence of moving air, and the fibers extending from the second membrane are formed of a material that generate an electrical charge, having an opposite polarity, in the presence of said moving air.

7. The filter device according to claim 1 wherein said filter section is treated with a bacteriostatic enzyme known as lysosyme.

* * * * *